United States Patent [19]

Stevens et al.

[11] Patent Number: 5,023,126

[45] Date of Patent: Jun. 11, 1991

[54] COMPOSITE TOWELS AND METHOD FOR MAKING COMPOSITE TOWELS

[75] Inventors: William P. Stevens, Oneida; Mark E. Dowey, Green Bay, both of Wis.

[73] Assignee: Fort Howard Corporation, Green Bay, Wis.

[21] Appl. No.: 428,474

[22] Filed: Oct. 30, 1989

Related U.S. Application Data

[63] Continuation of Ser. No. 104,397, Oct. 2, 1987, abandoned.

[51] Int. Cl.[5] ..... D21H 1/02; D21H 1/06

[52] U.S. Cl. ..... 428/126; 428/130; 428/535; 162/201

[58] Field of Search ..... 428/126, 130, 534, 535; 162/201

[56] References Cited

U.S. PATENT DOCUMENTS

| | | | |
|---|---|---|---|
| 2,913,365 | 11/1959 | Osborne et al. | 162/201 |
| 3,575,749 | 4/1971 | Kroyer | 156/62.2 |
| 3,581,706 | 6/1971 | Rasmussen | 118/312 |
| 3,669,778 | 6/1972 | Rasmussen | 156/62.2 |
| 3,769,115 | 10/1973 | Rasmussen et al. | 156/62.2 |
| 3,905,864 | 9/1975 | Curry et al. | 162/133 |
| 3,954,554 | 5/1976 | Curry et al. | 162/104 |
| 3,963,819 | 6/1976 | Kroyer et al. | 264/78 |
| 3,976,412 | 8/1976 | Attwood et al. | 425/81 |
| 4,011,034 | 3/1977 | Curry et al. | 425/80 |
| 4,014,635 | 3/1977 | Kroyer | 425/82 |
| 4,033,709 | 7/1977 | Kroyer | 425/224 |
| 4,046,622 | 9/1977 | Attwood et al. | 162/132 |
| 4,060,360 | 11/1977 | Tapp | 425/83 |
| 4,071,651 | 1/1978 | Hicklin et al. | 428/284 |
| 4,074,393 | 2/1978 | Hicklin et al. | 19/303 |
| 4,074,959 | 2/1978 | Curry et al. | 425/81.1 |
| 4,097,640 | 6/1978 | Curry et al. | 428/219 |
| 4,144,619 | 3/1979 | White et al. | 19/304 |
| 4,160,004 | 7/1979 | Curry et al. | 264/120 |
| 4,202,851 | 5/1980 | Kroyer | 264/113 |
| 4,494,278 | 1/1985 | Kroyer et al. | 19/304 |

*Primary Examiner*—Alexander S. Thomas

*Attorney, Agent, or Firm*—Michael, Best & Friedrich

[57] ABSTRACT

A folded towel and a method for making a folded towel comprised of a composite product including one surface formed by smooth tissue and an opposite surface formed by an absorbent dry formed fabric product.

4 Claims, 1 Drawing Sheet

HAMMERMILL
VACUUM
CONVERTER

COMPOSITE TOWELS AND METHOD FOR MAKING COMPOSITE TOWELS

This is a continuation of U.S. patent application Ser. No. 104,397, filed Oct. 2, 1987 now abandoned.

FIELD OF THE INVENTION

The invention relates to folded towels and methods for manufacturing toweling of the type which is folded and adapted to be housed in stacks in paper towel dispensers.

BACKGROUND PRIOR ART

One form of folded towel in commercial application is a C-fold towel. Such towels are bundled or stacked and housed in a dispenser. Dispensers of the type for use in dispensing folded towels commonly have a central chamber for containing a stack of towels and an opening or slot in the bottom of the dispenser whereby towels can be pulled one at a time from the dispenser. These towels are stacked in such a manner that the towels are delivered one at a time from the dispenser to the user.

One of the preferred ways for making highly absorbent products has been to manufacture those products using the Kroyer dry forming process. In that process, finely divided wood fibers dispersed in air are layed onto a forming wire by drawing air through the forming wire The formed mat is pressed between calendar rolls, and controlled quantities of moisture and binder are then sprayed onto the dry formed fiber mat. The mat is then heated and dried. The resulting product has a soft texture and is highly absorbent. Because of these qualities, dry formed or air laid products are particularly useful as a towel material. On the other hand, dry formed products have not been commercially employed in making folded towels such as C-fold towels. One of the characteristics of the dry formed product is that it is not folded as readily as paper commonly used in making paper towels, and production of folded towels often requires formation of sharp folds in the towel material. Additionally, the surface of the dry formed product has a high coefficient of friction such that the surfaces of adjacent towels will not slide against one another easily, and the dry formed towels cannot be properly dispensed one at a time from a conventional dispenser for use in dispensing folded towels.

Attention is directed to the following patents describing methods and apparatus for use in making dry formed products: the U.S. Kroyer Pat. No. 3,575,749, issued Apr. 20, 1971; the U.S. Kroyer Pat. No. 4,014,635, issued Mar. 29, 1977; the U.S. Rasmussen et al. Pat. No. 3,769,115, issued Oct. 30, 1973; the U.S. Curry et al. Pat. No. 4,097,640, issued June 27, 1978; the U.S. Curry et al Pat. No. 4,074,959, issued Feb. 21, 1978; and the U.S. Hicklin et al. Pat. No. 4,071,651, issued Jan. 31, 1978.

Attention is also directed to the U.S. Curry et al. Pat. No. 4,011,034, issued Mar. 8, 1977; the U.S. Tapp Pat. No. 4,060,360, issued Nov. 29, 1977; the U.S. Kroyer et al. Pat. No. 3,963,819, issued June 15, 1976; the U.S. Curry et al. Pat. No. 3,905,864, issued Sept. 16, 1975; the U.S. Rasmussen Pat. No. 3,669,778, issued June 13, 1972; the U.S. Rasmussen Pat. No. 3,581,706, issued June 1, 1971; and the U.S. Curry et al. Pat. No. 4,160,004, issued July 3, 1979.

Attention is further directed to the U.S. Kroyer Pat. No. 4,033,709, issued July 5, 1977; the U.S. White et al. Pat. No. 4,144,619, issued Mar. 20, 1979; the U.S. Kroyer Pat. No. 4,202,851, issued May 13, 1980; the U.S. Kroyer et al. Pat. No. 4,494,278, issued Jan. 22, 1985; the U.S. Attwood et al. Pat. No. 3,976,412, issued Aug. 24, 1976; the U.S. Attwood et al. Pat. No. 4,046,622, issued Sept. 6, 1977; the U.S. Hicklin et al. Pat. No. 4,074,393, issued Feb. 21, 1978; and the U.S. Curry et al. Pat. No. 3,954,554, issued May 4, 1976.

SUMMARY OF THE INVENTION

The present invention is directed to a towel of the type which can be dispensed from a towel dispenser with the facility of conventional folded towels and an improved method for making folded towels wherein the resulting towels have an external surface which is sufficiently smooth that two such towels can slide against one another without undue friction to permit towels to be dispensed individually and uniformly from a conventional towel dispenser of the type for use in dispensing such towels.

More specifically, towels embodying the present invention comprise an absorbent composite product including composite layers, one of the layers comprised of tissue formed by a conventional process for forming absorbent tissues. The remaining layer is comprised of a dry formed product and wherein one side or surface of the composite product is formed by the layer of tissue and the remainder of the composite product is comprised of the dry formed absorbent product.

In one embodiment of the invention the folded towel comprises a C-fold towel having a center panel and a pair of edge panels joined to the opposite edges of the center panel by sharp folds and being folded from the edges of the center panel toward one another. The edge panels each have a width which is somewhat less than one-half the width of the center panel and such that the first edge panel has an edge adjacent the longitudinal center line of the center panel and adjacent but in spaced relation from an edge of the other edge panel. The composite product forming the C-fold towel is also folded such that the tissue layer forms the outside surface of the C-fold towel.

The invention also includes a method for forming a folded towel including the steps of laying a layer of tissue onto a forming wire of a dry forming machine, depositing a layer of fiber material by a dry forming process onto the layer of tissue on the forming wire to form a composite mat, spraying a binder onto the composite mat, and heating the composite mat to cure the binder and to dry the composite mat to form a composite product adapted to be folded to form a folded absorbent towel.

Figures 1, 2, 3, 4, 5:
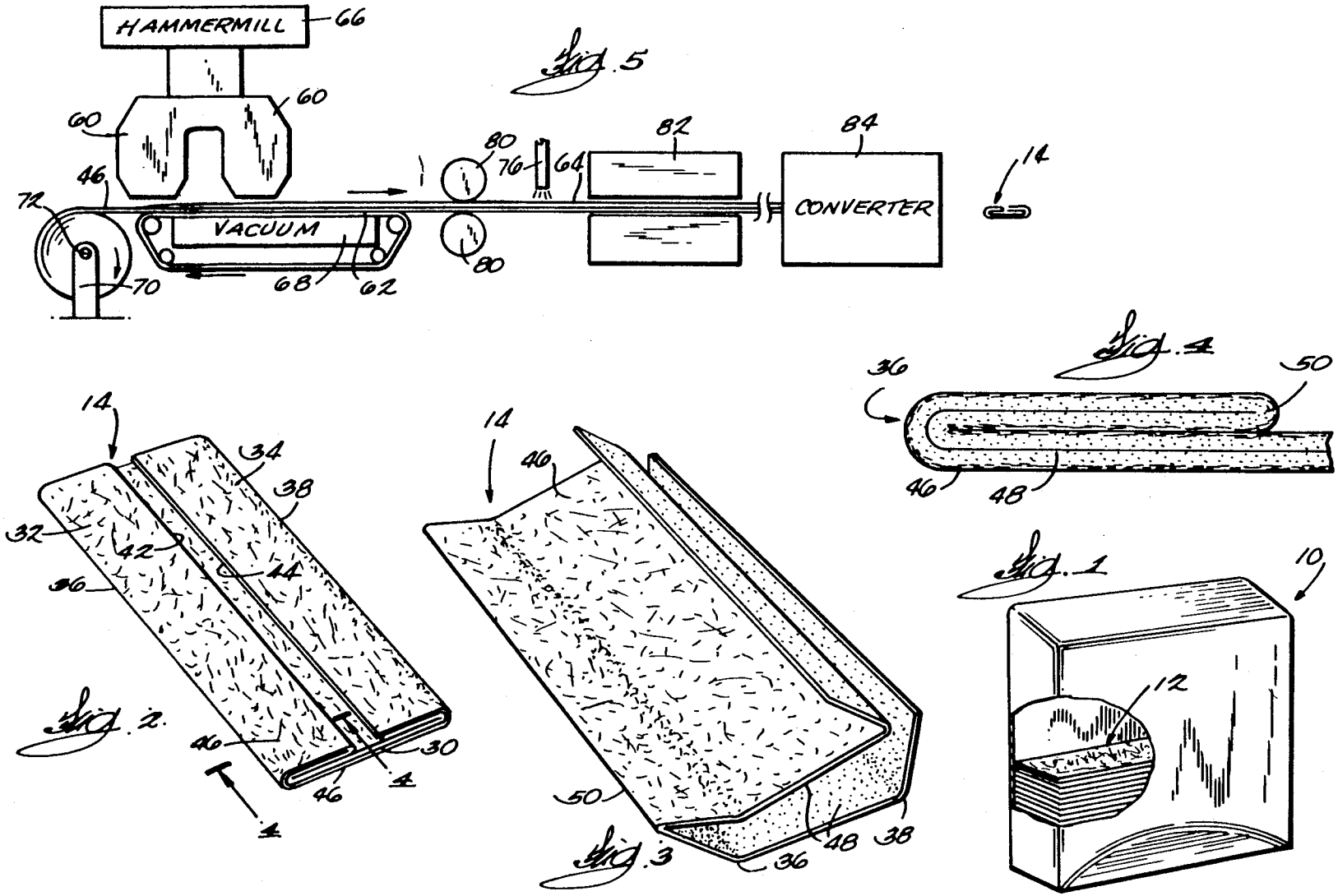
FIG. 1 is a perspective view of a dispenser for folded towels embodying the invention.
FIG. 2 is a perspective view of a C-fold towel embodying the invention.
FIG. 3 is an illustration of the towel shown in FIG. 2 partially folded.
FIG. 4 is an enlarged cross-section view of a section of the towel illustrated in FIG. 2 and taken along line 4—4.
FIG. 5 is a schematic view of the method and apparatus used in the manufacture of the C-fold towel illustrated in FIG. 2.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a paper towel dispenser 10 housing a stack 12 of folded towels 14 embodying the invention and with the folded towels 14 housed in the dispenser 10 such that they are readily removable one at a time from the bottom of the dispenser. While the folded towels 14 could be folded in other configurations, in the illustrated arrangement the towels 14 comprise C-fold towels. While the dispenser 10 could have other constructions of the type commonly used to dispense folded towels, in the illustrated arrangement the towel dispenser 10 is of the type for use in housing C-fold towels and includes a bottom portion having a central dispensing slot extending from adjacent one side of the dispenser to adjacent an opposite side of the dispenser. The C-fold towels 14 are housed or stacked in the dispenser in such a manner that the towels can be pulled through the slot in the bottom portion of the dispenser one at a time.

Illustrated in FIG. 2 is a C-fold towel 14 embodying the invention and of the type which can be conveniently dispensed from a towel dispenser 10 of the type shown in FIG. 1. The C-fold towel 14 includes a center panel portion 30 and a pair of edge panels 32 and 34 connected to the edges of the center panel 30, and the pair of edge panels 32 and 34 are folded over with respect to the center panel 30 toward one another. One edge of panel 32 is integrally connected by a sharp fold line 36 to an edge of the center panel 30, and an edge of the other edge panel 34 is connected by a second sharp fold line 38 to an opposite edge of the center panel 30. The edge panels 32 and 34 each define a plane parallel to the center panel portion 30 and are folded over the edges of the center panel portion. When folded as shown, the edge panels 32 and 34 include opposed spaced apart edges 42 and 44, respectively on opposite sides of a center line or longitudinal axis of the center panel portion 30.

C-fold towels of the type shown in FIG. 2 are formed from a composite product comprising a combination of a tissue material formed by a conventional wet forming paper making process and a second material comprised of an absorbent dry formed fabric product, the tissue material and the absorbent dry formed fabric being integrally joined together to form a composite absorbent towel. The composite product forming the towel is illustrated more clearly in FIG. 4. The composite product is comprised of a layer of tissue 46, formed in a conventional manner used in forming absorbent tissues such as facial tissues, and a layer of dry formed fabric 48, the layer of tissue 46 and the layer of dry formed fabric 48 being integrally joined together so as to form a single composite layer of material, but with the tissue 46 forming one surface of the composite layer and with the dry formed fabric 48 forming the opposite surface of the composite product.

As best illustrated in FIGS. 3 and 4, the towel is folded in such a manner that the tissue surface of the composite product forms the outside surface of the folded towel, and the dry formed fabric forms the inner surface of the folded towel. More specifically, as illustrated in FIG. 3, in the converting process wherein flat sheets of composite product are folded, and cut to size, the sheet of composite material is folded along fold line 50 such that the tissue surface 46 of the composite product will be on the outside. The folded material is then folded again along fold lines 36 and 38 to form the finished composite towel shown in FIG. 2. When the towel is folded in this manner, the external surface area of the towel 14 is comprised of the tissue material 46, whereas the interior surface of the towel is comprised of the dry formed fabric 48. By forming a towel wherein the outside surface of the towel is comprised of the tissue material, the exterior of the folded towel will have a soft, smooth surface with a relatively low coefficient of friction. Because of the smooth exterior surface, when the towels 14 are stacked in a dispenser 10, the towels 14 can easily slide with respect to one another and can be readily pulled or removed one at a time from the dispenser. Additionally, because of the provision of the dry formed layer 48, the towels also have a thick, soft consistency and are highly absorbent. Furthermore, because of the provision of the tissue layer 46, the resulting composite product is more readily folded than a dry formed product alone, and facilitates converting of the sheet product to form a folded towel such as a C-fold towel.

Illustrated schematically in FIG. 5 is an apparatus for use in making dry formed products of the type shown in FIGS. 2–4. The apparatus includes one or more headers 60 positioned above a continuously moving forming wire 62 and adapted to deposit finely divided fibers entrained in air onto the forming wire 62 to form a finely disbursed mat 64. The fibers disbursed in air are supplied to the headers 60 through conduits from a hammermill 66 wherein paper products or other wood fiber products are broken down into discrete fibers and disbursed or supported in a stream of air. A vacuum device 68 is provided beneath the forming wire 62 such that airborne wood fibers will be pulled downwardly onto the forming wire 62. Means are also provided for laying or depositing a continuous layer of tissue 46 onto the forming wire 62 so as to provide a supporting surface for the wood fibers to be deposited by the headers 60. The means for laying the tissue 46 onto the forming wire 62 includes a stand comprised of a pair of upright legs 70 and a crossbar 72 adapted to support a roll of tissue. The roll of tissue 46 is supported such that it can unroll in a clockwise direction as seen in FIG. 5 whereby the tissue can be continuously laid onto the forming wire 62 as the forming wire moves beneath the headers 60. The composite product is then conveyed continuously through a plurality of calendar rolls 80 where it is embossed.

Means are also provided for supplying a finely divided mist of water and binder onto the composite mat comprised of the tissue 46 and the dry formed fibers layed onto the tissue. While various means could be provided for applying the mixture of water and binder onto the composite mat, in the illustrated arrangement spray nozzles 76 are provided, and the water and binder are applied in amounts conventionally used in the manufacture of dry formed absorbent products using the Kroyer process. The composite mat is then conveyed through a heater 82 wherein the binder is cured and the composite product is dried and wound into a roll. The roll is then conveyed to a converting apparatus 84 wherein the product is folded and cut to form the C-fold towels. The towels 14 are also assembled in the converter so as to form stacks 12 suitable for installation in a conventional dispenser 10 for C-fold towels.

Various features of the invention are set forth in the following claims.

We claim:

1. A towel adapted to be housed in a dispenser in a stack of similar towels, the towel comprising:

a composite layer of material having opposite surfaces, the composite layer of material including a first layer of paper material defining one surface of the composite layer, the first layer of paper material comprising tissue having a smooth surface texture, and a second layer of material integrally joined to the first layer, the second layer defining the opposite surface of the composite layer of material, and the second layer of material being comprised of absorbent dry formed material, the material forming the towel being folded such that the first layer of paper material forms the outside surface of the towel, and the composite layer of material comprising a rectangle having opposite side edges and opposite ends, and wherein the rectangle is folded such that the opposite ends are positioned closely adjacent one another, and wherein the first layer of paper material forms the outside surface of the folded product.

2. A towel as set forth in claim 1 wherein the folded product includes opposite ends and a central portion, said opposite ends of the folded product being folded toward the central portion to form a C-fold towel.

3. A towel adapted to be housed in a dispenser in a stack of similar towels, the towel comprising:

a composite layer of material having opposite surfaces, the composite layer of material including a first layer of paper material defining one surface of the composite layer, the first layer of paper material comprising tissue having a smooth surface texture, and a second layer of material integrally bonded to the first layer of paper material, the second layer defining the opposite surface of the composite layer of material, and the second layer of material being comprised of absorbent dry formed material, the second layer of material being formed by dry forming airborne fibers onto the first layer of paper material and wherein the first layer of paper material is dry and supported on a forming surface, and the composite layer of material further being formed by spraying a mixture of water and binder onto the dry formed fibers supported by the first layer of paper material, heating the composite layer of material to cure the binder and dry the composite layer of material, the cured binder providing the bonding between the first layer of material and the second layer of material, the composite layer of material including a rectangle having opposite side edges and opposite ends, and being folded such that the opposite ends are positioned closely adjacent one another, and the first layer of paper material forming the outside surface of the folded product.

4. A towel as forth in claim 3 wherein the folded product includes opposite ends and a central portion, said opposite ends of the folded product being folded toward the central portion to form a C-fold towel.

* * * * *